US006059282A

United States Patent [19]

Jang

[11] Patent Number: 6,059,282

[45] Date of Patent: May 9, 2000

[54] AUTO SHEET FEED DEVICE FOR OFFICE AUTOMATION SYSTEMS

[75] Inventor: Heung-Kyu Jang, Suwon, Rep. of Korea

[73] Assignee: SamSung Electronics Co., Ltd., Kyungki-do, Rep. of Korea

[21] Appl. No.: 09/185,738

[22] Filed: Nov. 4, 1998

[30] Foreign Application Priority Data

Nov. 4, 1997 [KR] Rep. of Korea ..... 97-57856

[51] Int. Cl.[7] ..... B65H 3/34

[52] U.S. Cl. ..... 271/160; 271/167

[58] Field of Search ..... 271/167, 124, 271/169, 121, 160, 138, 137, 104

[56] References Cited

U.S. PATENT DOCUMENTS 5,775,688 7/1998 Kato et al. ..... 271/167

FOREIGN PATENT DOCUMENTS 63-74843 4/1988 Japan ..... 271/167

539136 2/1993 Japan ..... 271/167

*Primary Examiner*—David H. Bollinger

*Attorney, Agent, or Firm*—Robert E. Bushnell, Esq.

[57] ABSTRACT

An auto sheet feed device for an office automation system uses: a paper loading plate which moves upwardly and downwardly according to the quantity of paper loaded thereon; a loading pick up device for picking up paper loaded on an upper part of the paper loading plate according to a control signal; a pressurizer for maintaining the paper loading plate and the pick up device in close adherence to each other; a resistance plate for separating the paper picked up by the pick up device from the paper loading plate; and a resistance plate varying device for maintaining an entry angle between the resistance plate and the paper as paper is picked up by the pick up device. Preferably, the resistance plate varying device includes a rack gear formed on the paper loading plate, an idle gear contacting the rack gear and driver thereby, and a fan shaped gear rotated by movement of the idle gear to adjust the angle between the resistance plate and paper in the paper loading plate.

18 Claims, 6 Drawing Sheets

AUTO SHEET FEED DEVICE FOR OFFICE AUTOMATION SYSTEMS

CLAIM OF PRIORITY

This application makes reference to, incorporates the same herein, and claims all benefits accruing under 35 U.S.C. §119 from my application entitled Auto Sheet Feed Device of Office Automation Systems filed with the Korean Industrial Property Office on Nov. 4, 1997 and there duly assigned Ser. No.P97-57856 by that Office.

BACKGROUND OF THE INVENTION

1. Technical Field

The present invention relates an auto sheet feed device with a variable resistance plate and, more particularly, to an auto sheet feed device for office automation systems adopting a separation method for the variable resistance plate to improve the reliability of the paper feed. The paper entry angle and the angle of the separation resistance plate are maintained identical by the variable device of the resistance plate angle according to the variation of the paper quantity.

2. Related Art

Generally, many devices are used in office automation systems. A printer is an output device for making documents by outputting, in the form of letters on paper sheets, printed data, letters or graphics from a computer. A copier is a device for copying data in the form of documents or images as they appear. A facsimile transmits needed data to people over long distances in order that they can see the data directly.

Conventionally, data or files composed by users with computers become documents by being printed with various kinds of printers. However, the present invention will be exemplified with an ink jet printer. In such a printer, the pressure within a cartridge rises and bubbles occur like soap bubbles if ink stored in a cartridge is heated. The ink jet printer prints by forming letters and attaching them to the paper by jetting bubbles occurring at that time through a nozzle.

Numbers of nozzles used in an ink jet printer generally amount to about 64 pieces, and the resolution of pictures is usually about 300~1200 DPI (Dot Per Inch). Also color printing is possible with some sorts of installed cartridges.

In such office automation devices, feeding of paper in response to a print control signal is performed in a reliable manner in dependence on the angle between a resistance plate which separates paper from the feeder and the paper loaded in the feeder itself. This is complicated by the fact that, in the usual feeder, as paper is withdrawn, the entry angle of the paper changes due to rising of the loading plate on which the paper is loaded. Therefore, there is a need for the development of a device which compensates for the change in the entry angle of the paper by adjusting or varying the angle of the resistance plate.

SUMMARY OF THE INVENTION

Accordingly, in order to overcome such drawbacks in the art, it is an object of the present invention to provide a separation structure for the resistance plate having the most appropriate reliability. This is accomplished by realizing the separation feature for the uniformly fed paper irrespective of the quantity of loaded paper by making the resistance plate automatically variable in rotation to the same extent as the quantity of deviation of the entry angle of the paper according to the change in the quantity of loaded paper. Specifically, the separation structure of the prior resistance plate of fixed form is changed to a separation structure of an improved variable resistance plate.

It is another object of the present invention to provide various appropriate conditions without having an influence on the main frame by having the resistance plate fitted to the various paper features by forming the resistance plate independent of the frame.

To achieve these and other advantages and in accordance with the purpose of the present invention, as embodied and broadly described, there is provided an auto sheet feed device for office automation systems, comprising: a paper loading plate which moves upward and downward according to the quantity of loaded paper; a loading pick up device for picking up the paper loaded on the upper part of the paper loading plate according to a control signal; a pressurizer for maintaining the paper loading plate and the pick up device in close adherence to each other by means of a predetermined pressure; a resistance plate for separating the paper picked up by the pick up device from the paper loading plate; and a resistance plate varying device for maintaining the entry angle of the resistance plate and the paper uniformly.

According to another aspect of the present invention, there is also provided a resistance plate varying device comprising: a rack gear formed in the paper loading plate; an idle gear driven while geared to the rack gear; and a fan shaped gear rotating concentrically around a hinge shaft of the resistance plate while geared to the idle gear.

BRIEF DESCRIPTION OF THE ATTACHED DRAWINGS

A more complete appreciation of the invention, and many of the attendant advantages thereof will be readily apparent as the same becomes better understood by reference to the following detailed description when considered in conjunction with the accompanying drawings in which like reference symbols represent the same or similar components, wherein.

DETAILED DESCRIPTION OF PREFERRED EMBODIMENT

It will be apparent to those skilled in the art that various modifications can be made in the AUTO SHEET FEED DEVICE FOR OFFICE AUTOMATION SYSTEMS of the present invention, without departing from the spirit of the invention. Thus, it is intended that the present invention cover such modifications as well as variations thereof, within the scope of the appended claims and their equivalents.

The constitution and operation of the present invention is explained in conjunction with the accompanying drawings as follows.

Figure 1:
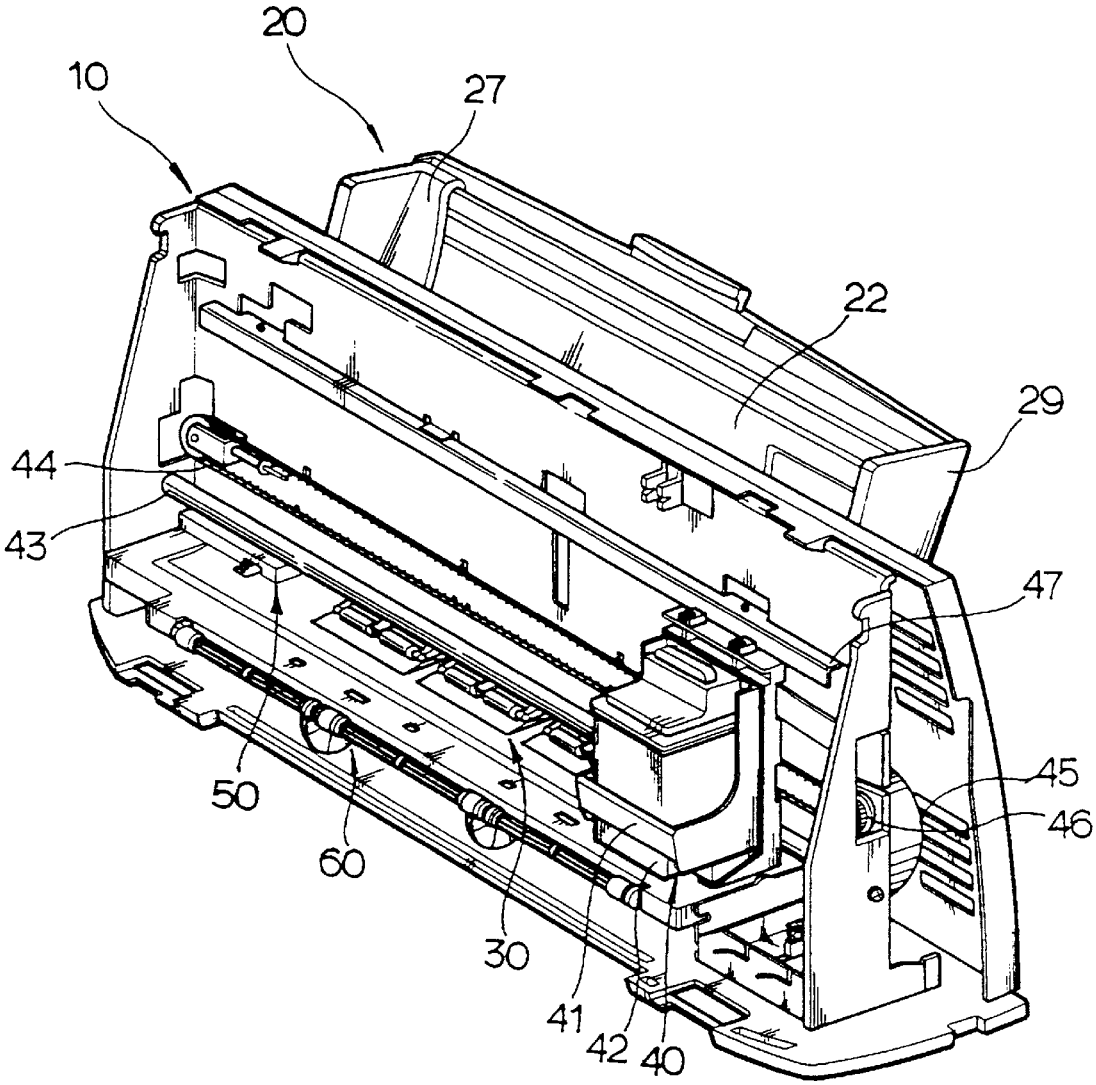
FIG. 1 is a perspective view illustrating the total construction of an ink jet printer.
Figure 2:
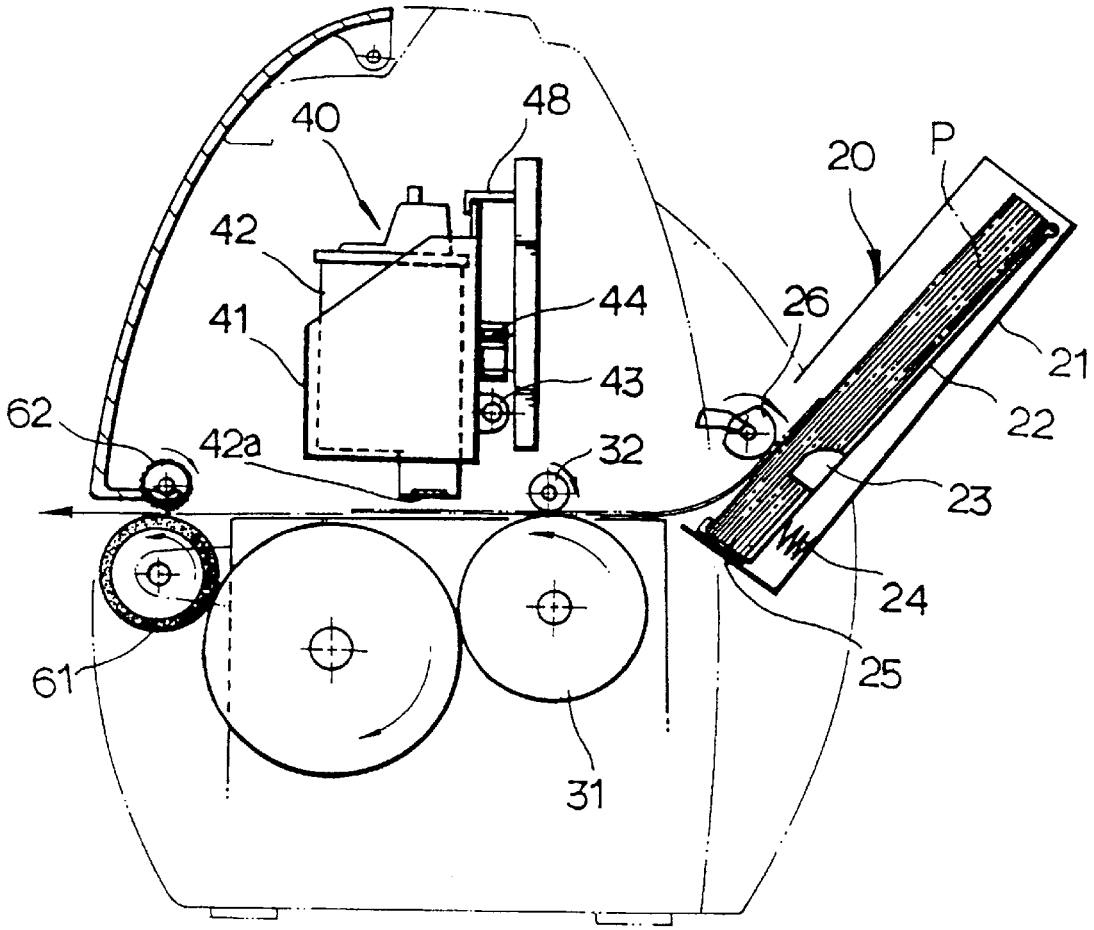
FIG. 2 is a right side view illustrating an operational diagram according to FIG. 1

A general printer 10, as illustrated in FIG. 1 and FIG. 2, comprises an auto paper feeder part feeding paper P for printing, a paper transporter part 30 transporting paper fed from the auto paper feeder part 20, a printing device part 40 printing on the paper transported by the paper transporter part 30, and paper discharger part 50 for discharging the paper printed by the printing device part 40 by passing it along a base frame 60 as a paper support.

The operation of the latter structure can be described in detail in conjunction with FIG. 1 and FIG. 2, as follows. First, when paper is loaded in the upper side of a knock up plate 22 of the auto paper feeder part 20 by a user, it is adjusted to the size of the loaded paper in movement to the right and left directions with a left guide 22 in a state adhering closely to a right guide 23 fixed to the right side.

When the adjustment is performed according to the size of the loaded paper, and the user gives the print command to print the data from the computer, paper is stacked by the elastic force of a knock up spring 23 for stacking the paper, and then a pick up roller 28 picks up the paper stacked in the knock up plate 22 and transports the paper sheets, one by one, for printing by feeding them to the paper transporter part 30.

The paper transported to the paper transporter part 30 is transported to the printing device part 40 by the rotational pressure of a feed roller 31 and a friction roller 32.

If the paper is fed from the paper transporter part 30, then a carriage driving motor 45 drives a pulley 46, which drives a belt 44 in the left and right directions. The paper is printed by jetting ink on the paper transported from the transporter part 30 by nozzle 42*a* attached to the cartridge 42 which slides to the left and right along a carriage shaft 43 while being fixed to the guide rail 46 to prevent separation.

Subsequently, the paper printed by the nozzle 42a mounted on the cartridge 42 moves gradually while being printed line by line on a base frame 50. When the printed paper reaches the paper discharger part 60, a discharge operation for discharging the paper is performed by passing it between a discharge roller 61 and a star wheel 62.

Thus, the print process of the ink jet printer can be described as follows. First, the paper is loaded into the paper feeder part 20. It is then transported to the paper transporter part 30 according to a print command. Thereafter, the printing device part 40 discharges the printed paper, according to a print control command, through the paper discharger part 60, and the process ends. The systems for feeding paper to print are divided into those employing the CLAW separation method, the resistance plate separation method, the friction pad separation method, and the roller reverse rotation separation method.

A particular auto separation method is chosen in dependence on the price of the goods, the reliability, the spatial area, and the property of the paper when the goods are produced. In office automation systems using a printer, such various special paper as general copy paper like A4, OHP paper, a postcard and a letter envelope are used. Therefore, the CLAW separation method and the resistance plate separation method are combined and used together.

Figure 3:
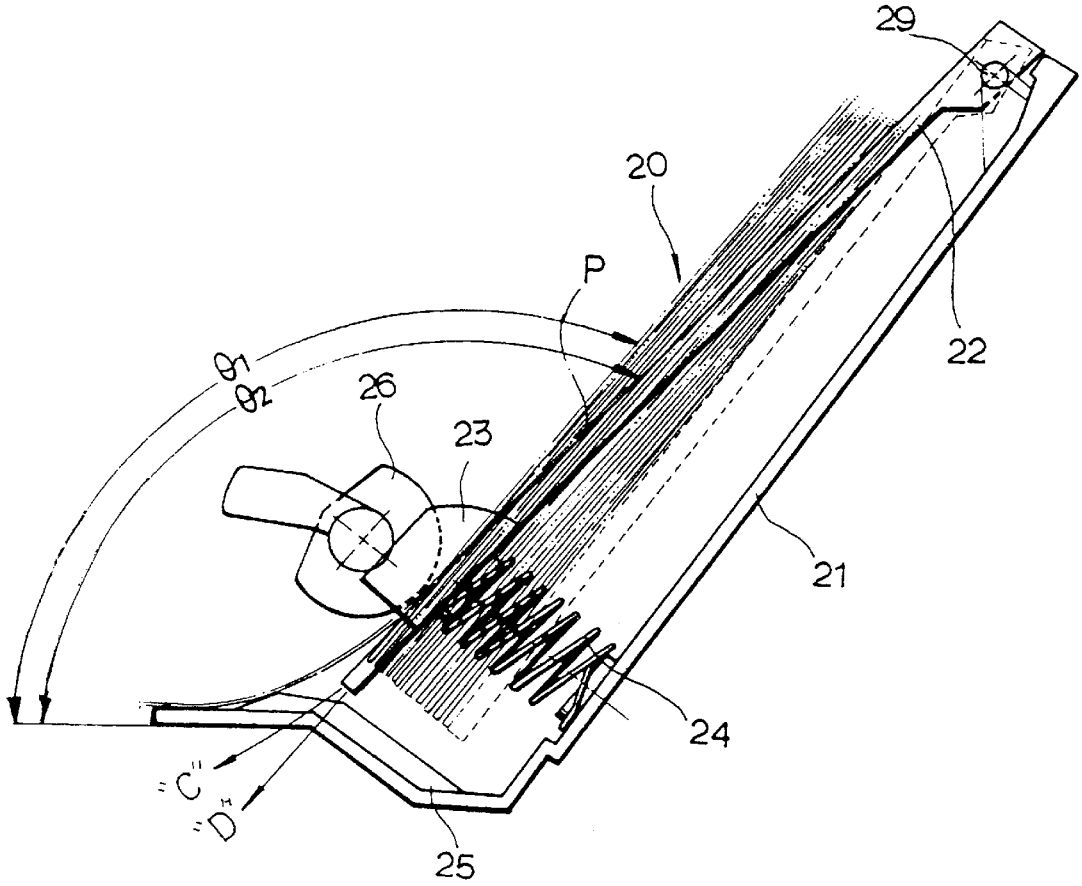
FIG. 3 is a right side view illustrating problems occurring in feeding paper with the resistance plate separation method.

That is, the method makes use of the difference in the friction power between the resistance plate and the entry angle of the paper according to the resistance plate separation method. The entry angle of the paper loaded on the uppermost edge and the entry angle of the resistance plate have a very important function, and become factors controlling the reliability of the paper feed The structure of the auto paper feeder part 20, feeding the paper by taking advantage of the separation method using such resistance plate, can be described in conjunction with FIG. 3, as follows. As a separation resistance plate 25 for separating the paper is fixed in a body to the left upper edge of the main frame 21, the variability in the entry angle occurring due to the difference in the quantity of paper loaded according to paper consumption cannot be absorbed Namely, the knock up plate 22 is pushed downward and the entry angle of the paper fully loaded on the uppermost edge tends toward the direction D, when new paper is loaded to a maximum amount or exchanged after all the paper loaded on the upper edge of the knock up plate 22 has been picked up and used.

After this, if the paper is continuously used, the loaded paper gets lower and lower, and the knock up plate 22 ascends upward due to the elastic force of the knock up spring 23. Thus, the entry angle of the paper changes toward the direction C.

Accordingly, the entry angle of the paper comes to decline by as much as an angle $\alpha$. Such a decline in the entry angle ($\alpha=\theta 1-\theta 2$) changes the separation feature of the paper for the fixed resistance plate 25. As a result, there is a problem in that reliability of the paper feed decreases.

Further, the separation structure of the resistance plate 25 is formed in a body with the main frame 21, and thus cannot absorb the entry angle of the paper. Accordingly, the separation feature of the paper is changed. As a result, the following problems occur: multi-feeding (plural sheets are fed at the same time), sheet jamming, and non-feeding (paper is not fed).

In particular, there is a problem in that the structural plan of fitting the independent resistance plate to the various paper features is not possible because the structure of the resistance plate 25 is made in a body with main frame 21.

In the process of making the most appropriate condition of the resistance plate, a shape such as a rib is supplemented or changed. Moreover, the correction works of the metal mold have many restrictions and thus correction of the metal mold is impossible, and also repeated correction works shorten the life span of the metal mold.

Figure 4:
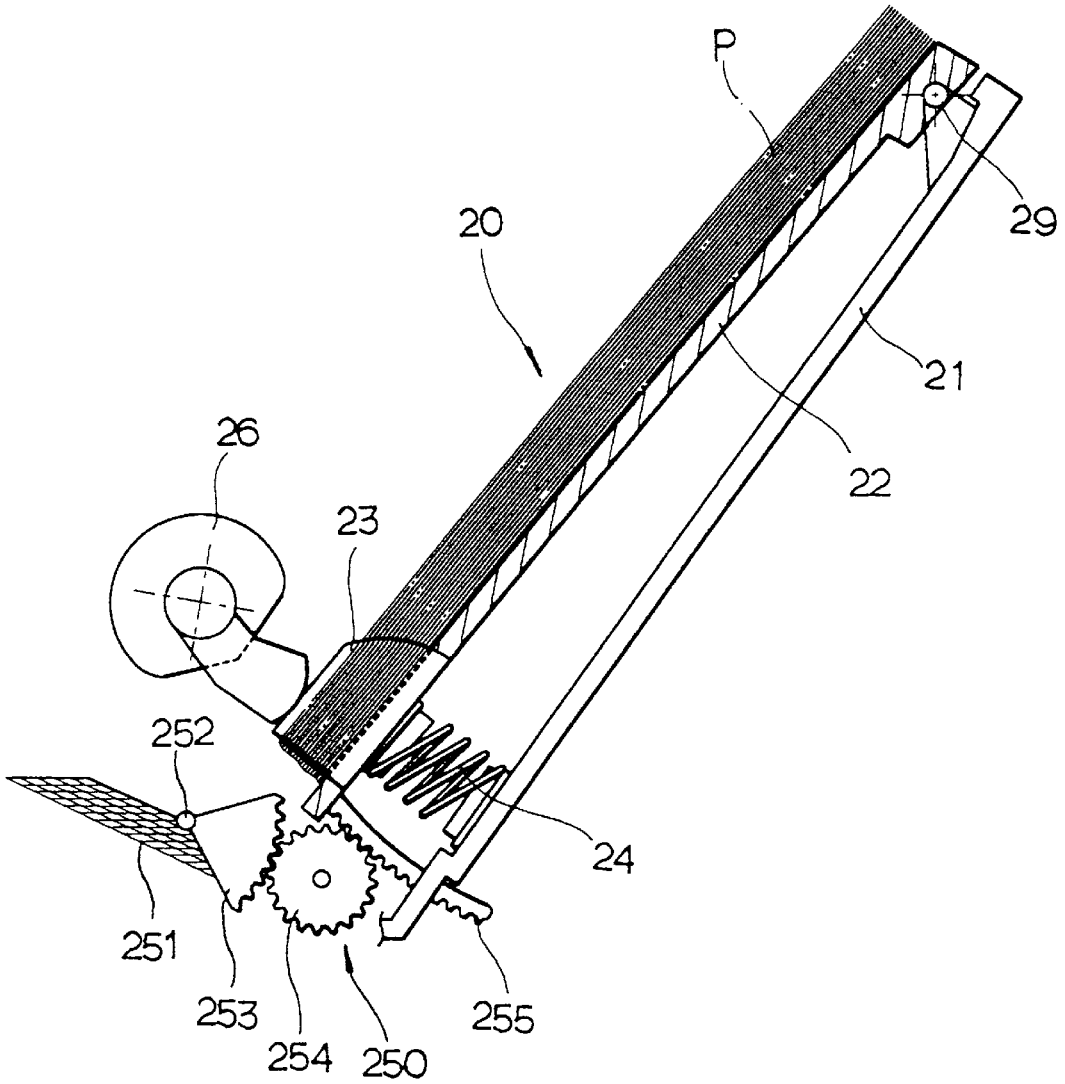
FIG. 4 illustrates a right side view according to the present invention.
Figure 5:
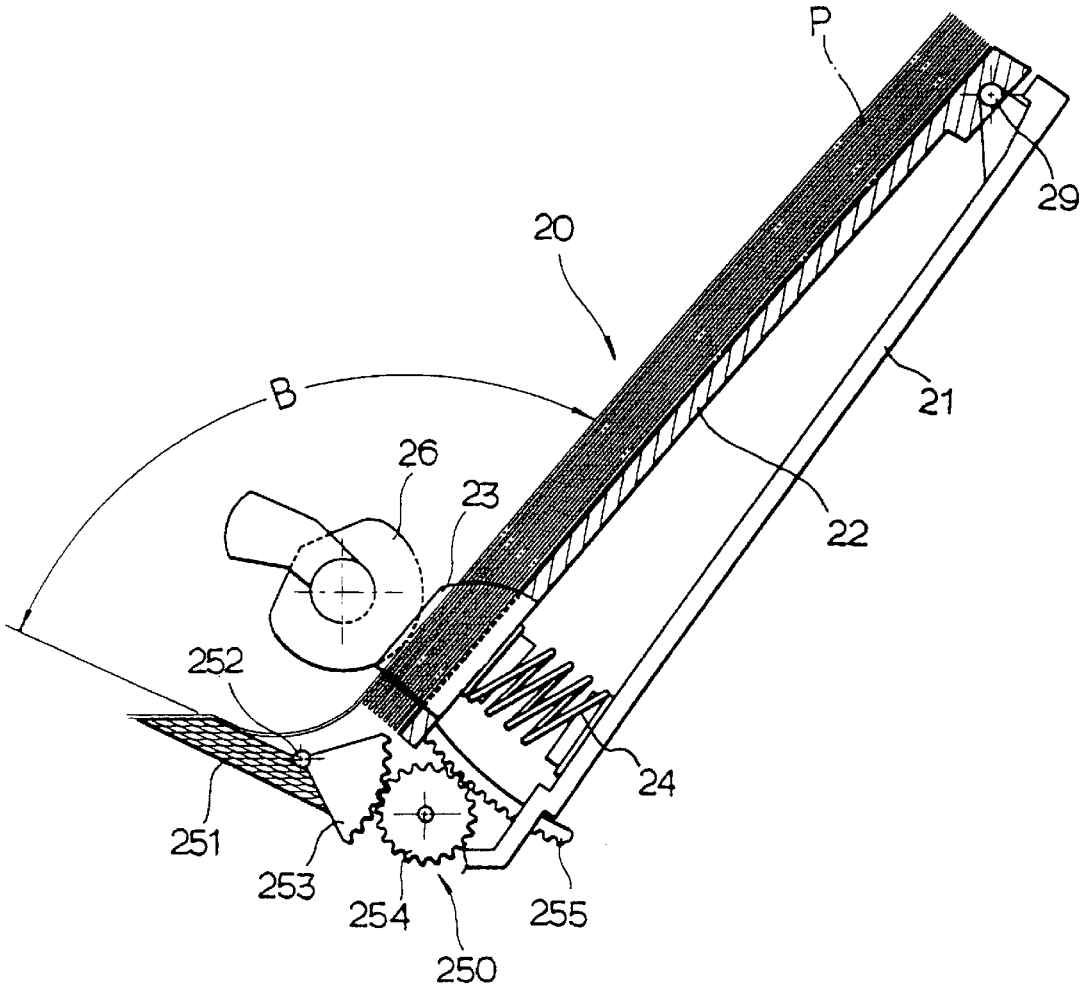
FIG. 5 and FIG. 6 illustrate an operational view according to FIG. 4.
Figure 6:
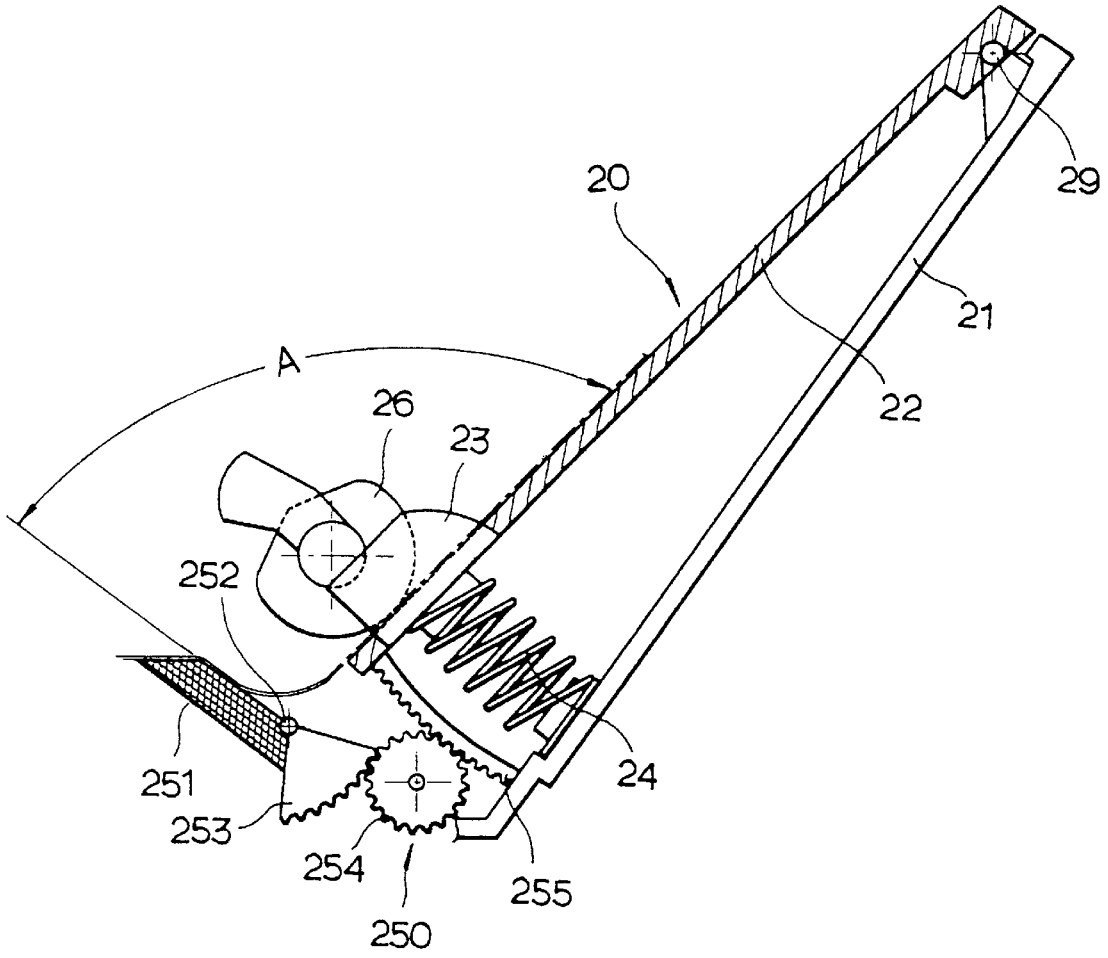

FIG. 4 illustrates a right side view of the auto sheet feeder according to the present invention, and specifically a state in which paper is loaded on the auto sheet feeder part 20. FIG. 5 and 6 illustrate a driving process for the auto sheet feeder part 20 according to the present invention First, as shown in FIG. 4, one side of the auto sheet feeder part 20 is attached to the resistance plate varying device part 250, comprising: a variable resistance plate 251 for maintaining the paper entry angle uniform irrespective of the quantity of loaded paper; a fan shaped gear 253 rotating concentrically around a hinge shaft 252 on one side of the variable resistance plate 251; a rack gear 255 formed on an end of the knock up plate 22; and an idle gear 254 for turning the fan shaped gear 253 according to the driving of the rack gear 255.

In other words, variable resistance plate 251 maintains the paper entry angle at a uniform amount irrespective of the quantity of loaded paper, and the variable resistance plate 251 is rotated minutely according to the left or right rotation angle of the fan shaped gear 253 which rotates around a hinge shaft 252 located on one side of the variable resistance plate 251.

The auto sheet feeder part 20 of an office automation system comprises: a knock up plate 22 which moves upward and downward according to the quantity of paper loaded while rotating around hinge 29; semicircular pick up roller 26 which picks up the paper loaded on the knock up plate 22 according to a print signal; and a knock up spring 24 on one side of the main frame 21 for urging the knock up plate 22 upward and for operating smoothly to prevent contact noise with the knock up plate 22 when the pick up roller 26 is picking up paper sheets from knock up plate 22.

The rack gear 255 formed on an end of the knock up plate 22 is attached to the left part of the knock up spring 24. The rack gear 255 is arranged to move according to the upward and downward driving of the knock up plate 22. The idle gear 254 rotates counterclockwise or clockwise depending on whether the knock up plate 22 is moving upward or downward.

Thus, the idle gear 254 is driven according to the driving of the lock gear 255, and thereby causes the fan shaped gear 253 to turn. In this manner, the variable resistance plate 251 is rotated minutely.

The operation process according to such a structure can be considered in detail in conjunction with FIG. 5 and FIG. 6, as follows. As illustrated, if the paper is loaded to a maximum capacity on the auto sheet feeder part 20, then the knock up plate 22 is pushed downward and the knock up spring 24 is compressed.

Furthermore, when the knock up plate 22 is pushed downward, the rack gear 255 which is attached to the knock up plate 22 moves downward, and therefore the idle gear 254 rotates clockwise.

When the idle gear 254 is rotated clockwise by the rack gear 255, the fan shaped gear 253 installed on the variable resistance plate 251 rotates the variable resistance plate 251 minutely around the hinge shaft 252.

Accordingly, as in FIG. 5, an angle B is formed between the paper P and the variable resistance plate 251.

Thereafter, the printer gets a print command from the computer according to the printing commands of the user for printing the data from the computer.

The print commands allow the pick up roller 26 to continuously pick up paper, and so the height of the loaded paper becomes lower and lower. As a result, the knock up plate 22 on which the paper is loaded rises gradually under the restoring force of the knock up spring 24.

Further, as the knock up plate 22 rises gradually in response to the picking up of paper by the pick up roller 26, the rack gear 255 attached to the knock up plate 22 also rises.

As the rack gear 255 rises, it turns the idle gear 254 counterclockwise, and the fan shaped gear 253 rotates clockwise.

Consequently, as in FIG. 6, an angle A is formed because the variable resistance plate 251 is rotated minutely.

As the angle between paper P and the variable resistance plate 251 varies between A and B according to the quantity of loaded paper, the separation feature between the entry angle of the paper and the friction angle of the resistance plate is preserved in a uniform manner irrespective of the quantity of loaded paper. Accordingly, the reliability of the paper feed separation improves.

As explained above, as the present invention has a separation resistance plate independent of the man frame and the structure fitting to the various paper features, a certain separation feature of the paper feed irrespective of the quantity of loaded paper is realized. Accordingly, it fulfills the high reliability of the paper feed function.

Furthermore, the number of times that the paper is exchanged is reduced by maxim the paper loading quantity, convenience increases and the plan most fitting to the paper feed function is made possible, irrespective of the main frame. The fixing and converting of the metal mold also becomes possible.

It should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. An auto sheet feed device for an office automation system, comprising:

a paper loading plate which moves upward and downward according to a quantity of loaded paper;

a pick up device for picking up the paper loaded on said paper loading plate according to a control signal;

a pressurizer for causing said paper loading plate and said pick up device to adhere closely to each other in accordance with a predetermined pressure;

a resistance plate for separating the paper picked up by said pick up device from said paper loading plate; and a resistance plate varying device for varying an orientation of said resistance plate in response to movement of said paper loading plate so as to maintain an entry angle between said resistance plate and said paper irrespective of the quantity of paper loaded on said paper loading plate.

2. The device as claimed in claim 1, wherein said resistance plate varying device comprises:

a rack gear formed on said paper loading plate;

an idle gear connected to and driven by said rack gear; and a fan shaped gear connected to said idle gear and rotating around a hinge shaft of said resistance plate while being geared to said idle gear.

3. The device as claimed as claim 2, wherein said idle gear turns said fan shaped gear as said idle gear is driven by said rack gear attached to said paper loading plate.

4. The device as claimed as claim 3, wherein said resistance plate is rotated in accordance with an angle of rotation of said fan shaped gear.

5. The device as claimed as claim 4, wherein said rack gear is mounted on said paper loading plate and moves in accordance with the quantity of loaded paper thereon.

6. The device as claimed in claim 5, wherein said pressurizer comprises a spring underlying said paper loading plate and operating against a quantity of the loaded paper to urge said paper loading plate upwardly.

7. The device as claimed as claim 3, wherein said rack gear is mounted on said paper loading plate and moves in accordance with a quantity of the loaded paper thereon.

8. The device as claimed as claim 2, wherein said rack gear is mounted on said paper loading plate and moves in accordance with a quantity of the loaded paper thereon.

9. The device as claimed as claim 2, wherein said resistance plate is rotated in accordance with an angle of rotation of said fan shaped gear.

10. The device as claimed in claim 1, wherein said pressurizer comprises a spring underlying said paper loading plate and operating against a quantity of the loaded paper to urge said paper loading plate upward.

11. An auto sheet feed device for an office automation system, comprising:

a paper loading plate for holding loaded paper and moving according to a quantity of the loaded paper;

pick up means for picking up sheets of the loaded paper from said paper loading plate;

a resistance plate located adjacent to said paper loading plate and said pick up means for separating the sheets picked up by said pick up means from said paper loading plate; and resistance plate varying means connected to said paper loading plate and responsive to movement of said paper loading plate for moving said resistance plate so as to maintain an angle between said loaded paper and said resistance plate as said loaded paper is picked up from said paper loading plate.

12. The device as claimed in claim 11, further comprising spring means located below said paper loading plate for exerting a generally upward force on said paper loading plate in opposition to a weight of said loaded paper.

13. The device as claimed in claim 11, wherein said resistance plate varying means comprises:

a rack gear formed on said paper loading plate;

an idle gear connected to and driven by said rack gear; and a fan shaped gear connected to said idle gear and rotating around a hinge shaft of said resistance plate while being geared to said idle gear.

14. The device as claimed as claim 13, wherein said idle gear turns said fan shaped gear as said idle gear is driven by said rack gear attached to said paper loading plate.

15. The device as claimed as claim 14, wherein said resistance plate is rotated in accordance with an angle of rotation of said fan shaped gear.

16. The device as claimed as claim 15, wherein said rack gear is mounted on said paper loading plate and moves in accordance with a quantity of the loaded paper thereon.

17. The device as claimed as claim 14, wherein said rack gear is mounted on said paper loading plate and moves in accordance with a quantity of the loaded paper thereon.

18. The device as claimed as claim 13, wherein said resistance plate is rotated in accordance with an angle of rotation of said fan shaped gear.

* * * * *